US006443103B1

(12) United States Patent
Carbone et al.

(10) Patent No.: US 6,443,103 B1
(45) Date of Patent: Sep. 3, 2002

(54) FLAMMABLE VAPOR RESISTANT WATER HEATER WITH LOW NOX EMISSIONS

(75) Inventors: Philip Carbone, North Reading; Karen Benedek, Winchester; Judith Reich, North Andover; Dewi Bramono, Malden, all of MA (US)

(73) Assignee: SRP 687 Pty. Ltd. (AU)

( * ) Notice: Subject to any disclaimer, the term of this patent is extended or adjusted under 35 U.S.C. 154(b) by 0 days.

(21) Appl. No.: 09/932,305

(22) Filed: Aug. 17, 2001

(51) Int. Cl.[7] ..... F22B 5/00
(52) U.S. Cl. ..... 122/14.31; 122/17.1
(58) Field of Search ..... 122/13.01, 14.31, 122/17.1; 126/307 A, 350.1; 431/346

(56) References Cited

U.S. PATENT DOCUMENTS

| | | | | |
|---|---|---|---|---|
| 796,924 | A | | 8/1905 | McCartney |
| 4,869,232 | A | | 9/1989 | Narang |
| 5,020,512 | A | | 6/1991 | Vago et al. |
| 5,335,646 | A | | 8/1994 | Katchka |
| 5,427,525 | A | | 6/1995 | Shukla et al. |
| 5,448,969 | A | | 9/1995 | Stuart et al. |
| 5,646,413 | A | | 7/1997 | Benedek et al. |
| 5,649,822 | A | | 7/1997 | Gertler et al. |
| 5,797,355 | A | | 8/1998 | Bourke et al. |
| 5,937,796 | A | | 8/1999 | Sebastiani |
| 5,954,492 | A | * | 9/1999 | Lannes et al. ..... 122/14 |
| 6,295,952 | B1 | * | 10/2001 | Reynolds et al. ..... 122/14.31 |

* cited by examiner

*Primary Examiner*—Gregory Wilson
(74) *Attorney, Agent, or Firm*—Schnader Harrison; Segal & Lewis LLP

(57) ABSTRACT

A water heater including a water container; a combustion chamber adjacent the container, the combustion chamber having at least one flame arrestor to admit air and extraneous fumes into the combustion chamber and confine ignition and combustion of the extraneous fumes within the combustion chamber; a burner associated with the combustion chamber and arranged to combust fuel to heat water in the container; an air diverter positioned between the flame arrestor and the burner and adapted to channel at least a portion of combustion air passing through at least a portion of the flame arrestor to a position for mixture with the fuel prior to entering the burner to ensure uniform combustion; and a flange positioned above the air diverter to which the flames attach and thereby reduce combustion temperatures; the combined effect of which is to optimize combustion performance and minimize $NO_x$ and CO emissions.

21 Claims, 6 Drawing Sheets

FLAMMABLE VAPOR RESISTANT WATER HEATER WITH LOW NOX EMISSIONS

FIELD OF THE INVENTION

This invention relates to water heaters, particularly to improvements to gas fired water heaters adapted to render them safer for use and to reduce $NO_x$ emissions.

BACKGROUND

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is a common procedure for such machinery to be refueled in such locations.

There have been a number of reported instances of spilled gasoline and associated extraneous fumes being accidently ignited. There are many available ignition sources, such as refrigerators, running engines, electric motors, electric and gas dryers, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes," "fumes" or "extraneous gases" are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges capable of enabling ignition are or are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite.

For example, the range for common gasoline vapor is between about 2% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (e.g. propane and butane) or liquids which form fumes having a density close to that of air, (e.g. gasoline, which may contain butane and pentane among other components, is very typical of such a liquid fuel).

In reconstructions of accidental ignition situations, and when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

Earlier efforts, such as those disclosed in U.S. Pat. No. 5,797,355, substantially raised the probability of successful confinement of ignition of spilled flammable substances from typical spillage situations to the inside of the combustion chamber. Other following structures, such as those disclosed in U.S. Pat. Nos. 5,950,573; 6,003,477; 6,082,310; 6,085,699; and 6,085,700, for example, have built on the break through success of '355.

Although the water heaters described in the above-identified patents have been well received and highly successful with respect to increasing the resistance to ambient flammable vapors, certain portions of the U.S., especially California, have stringent low $NO_x$ emissions regulations and requirements. We have discovered an ongoing challenge associated with meeting these limits with such structures. Accordingly, it has been a primary objective to produce a water heater that simultaneously addresses the issue of resistance to flammable vapors and can meet ever increasingly stringent low $NO_x$ emissions regulations and requirements by the various regulatory bodies.

One attempt to limit $NO_x$ emissions is U.S. Pat. No. 5,645,413 to Benedek et al., which discloses a water heater designed to operate with unlimited burner primary air, and a key feature is to recirculate secondary air to the primary combustion flame region. In '413, the flame guide and burner are an integral system such that the burner does not function separately from the flame guide.

SUMMARY OF THE INVENTION

This invention relates to a water heater including a water container and a combustion chamber adjacent the container. The combustion chamber has a side wall and at least one flame arrestor to admit air and extraneous fumes into the combustion chamber and confine ignition and combustion of the extraneous fumes within the combustion chamber. A burner having a multiplicity of burner ports is associated with the combustion chamber and arranged to combust fuel to heat water in the container.

An air diverter including a substantially flat plate having a central opening larger than the diameter of the burner is positioned in the combustion chamber and below the burner ports in the burner. The plate is sized to create a gap between its outer edge and the side wall and is adapted to channel combustion air passing through at least a portion of the flame arrestor through the gap. A flange is positioned above the air diverter and has a central opening of a size and alignment substantially the same as that of the air diverter and the flange is angled upwardly and away from the air diverter in the radially outwardly direction and is positioned relative to the burner ports such that burner flames tend to attach thereto.

DETAILED DESCRIPTION OF THE INVENTION

Figure 1:
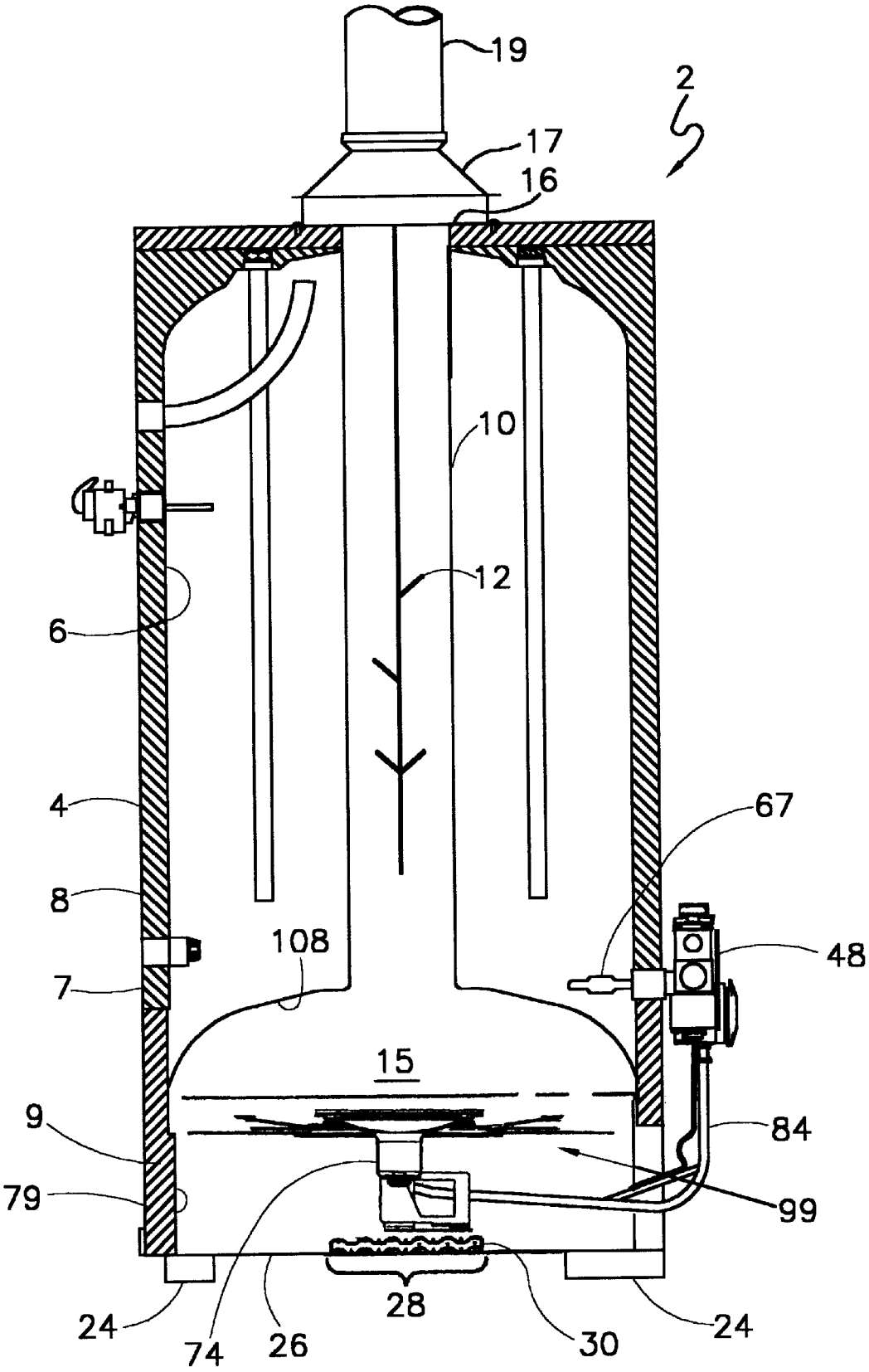
FIG. 1 is a schematic partial cross-sectional view of a gas-fueled water heater having an air inlet and low $NO_x$ air distributor according to the invention.
Figure 2:
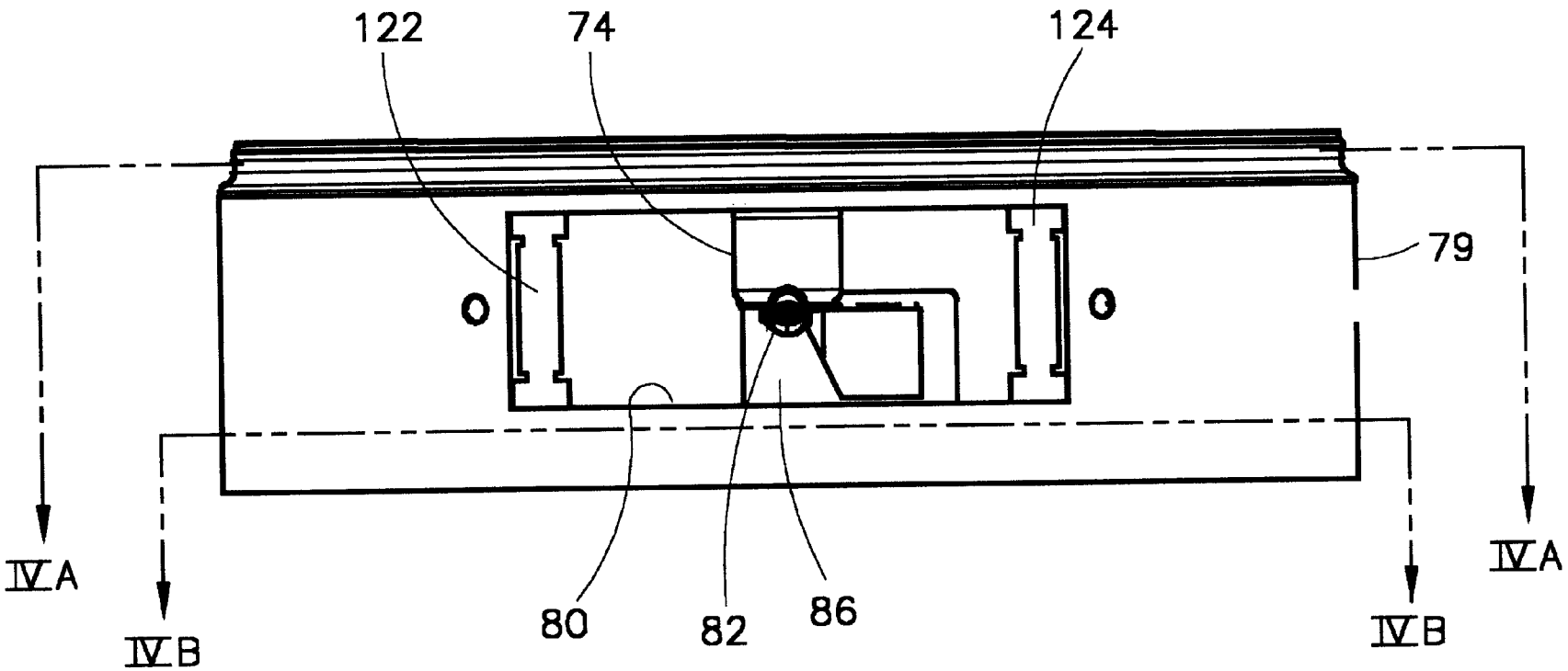
FIG. 2 is a front elevational view of the combustion chamber of the water heater of FIG. 1 with the access door and fuel supply means removed for ease of viewing.
Figure 3:
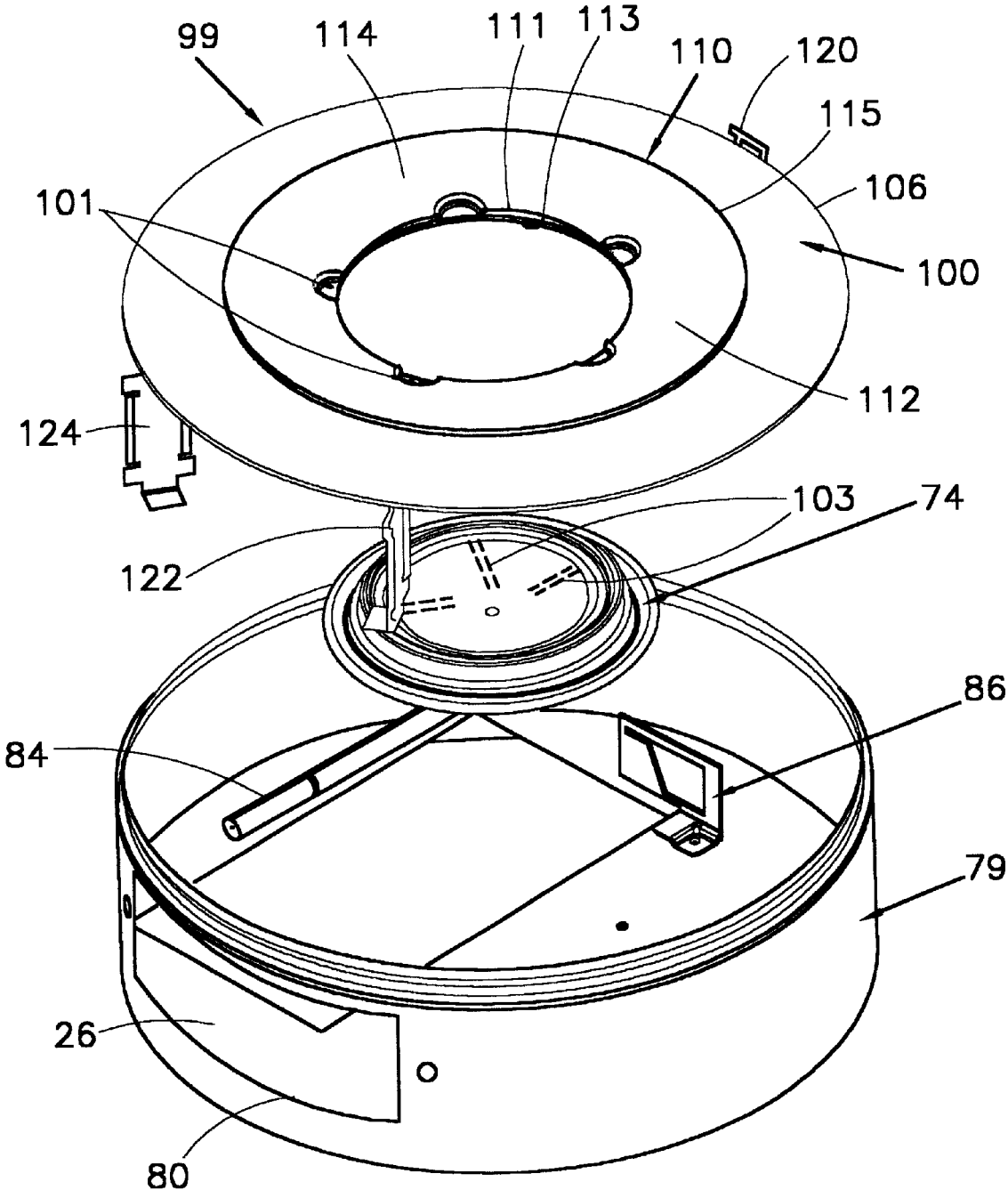
FIG. 3 is a schematic perspective view of a burner and low $NO_x$ air distributor according to the invention broken apart for ease of understanding.
Figure 4:
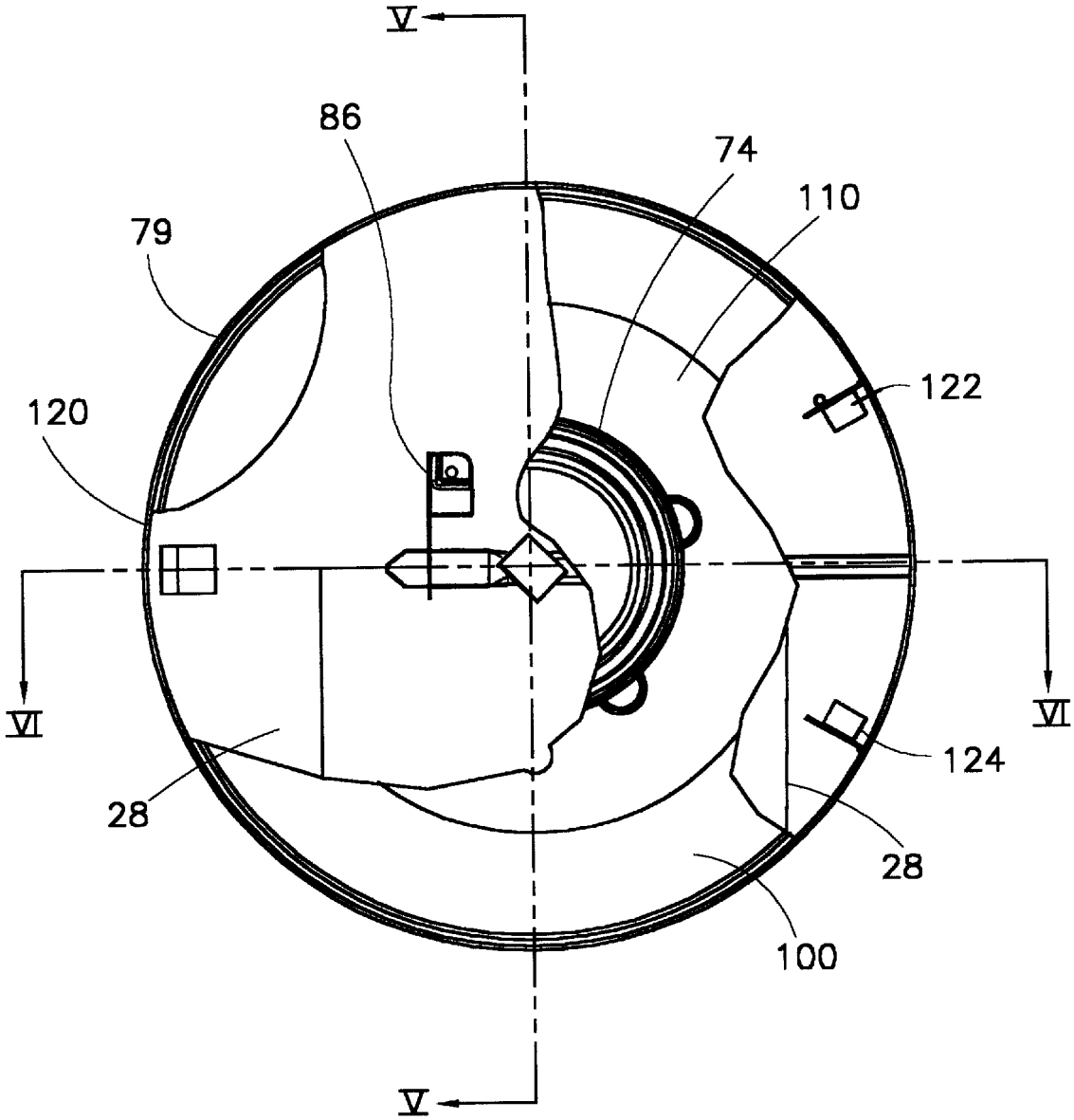
FIG. 4 is a plan view taken through the line IVA—IVA of FIG. 2, with portions taken through line IVB—IVB.

It will be appreciated that the following description is intended to refer to the specific embodiments of the invention selected for illustration in the drawings and is not intended to limit or define the invention, other than in the appended claims.

Turning now to the drawings in general and FIG. 1 in particular, there is illustrated a storage type gas water heater 2 including jacket 4 which surrounds a water tank 6 and a main burner 74 in an enclosed chamber 15. Water tank 6 is preferably capable of holding heated water at mains pressure and is preferably insulated by foam insulation 8. Alternative insulation may include fiberglass or other types of fibrous insulation and the like. Fiberglass insulation 9 surrounds chamber 15 at the lowermost portion of water tank 6. It is possible that heat resistant foam insulation can be used if desired. A foam dam 7 separates foam insulation 8 and fiberglass insulation 9.

Located underneath water tank 6 is a pilot burner (not shown) and main burner 74 which preferably use natural gas as fuel or other gases such as LPG, for example. Other suitable fuels may be substituted. Main burner 74 receives combustion air through flame arrestor 30, which is located at opening 28, and then combusts gas admixed with air and the hot products of combustion rise up through flue 10, possibly with heated air. Water tank 6 is lined with a glass coating (not shown) for corrosion resistance. The thickness of the coating on the exterior surface of water tank 6 is about one half of the thickness of the interior facing surface to prevent "fish scaling". Also, the lower portion of flue 10 is coated (not shown) to prevent scaling that could fall into chamber 15 and possibly partially block off flame arrestor 30.

The fuel is supplied to both burner 74 through a gas valve 48 and fuel line 84. Flue 10 in this instance, contains a series of baffles 12 to better transfer heat generated by main burner 74 to water within tank 6. Near the pilot burner is a flame detecting thermocouple (not shown) which is a safety measure to ensure that, in the absence of a flame at the pilot burner, the gas control valve 48 shuts off the gas supply. The water temperature sensor 67, preferably located inside the tank 6, co-operates also with the gas control valve 48 to supply gas to the main burner 74 on demand.

The products of combustion pass upwardly and out the top of jacket 4 via flue outlet 16 after heat has been transferred from the products of combustion. Flue outlet 16 discharges conventionally into a draught diverter 17 which in turn connects to an exhaust duct 19 leading outdoors.

Water heater 2 is mounted preferably on legs 24 to raise the base 26 of the combustion chamber 15 off the floor. As noted above, an aperture 28 is closed gas tightly by flame arrestor 30 which admits air for combustion of the fuel gas combusted through main burner 74 and the pilot burner, regardless of the relative proportions of primary and secondary combustion air used by each burner. Flame arrestor 30 is preferably made from a thin metallic perforated sheet of stainless steel, such as described in U.S. Pat. No. 6,085,699, for example.

Where base 26 meets the vertical combustion chamber wall or skirt 79, adjoining surfaces can be either one piece or alternatively sealed thoroughly to prevent ingress of air or flammable extraneous fumes. Gas, water, electrical, control or other connections, fittings or plumbing, wherever they pass through combustion chamber wall 79, such as at opening 80, are sealed with a closure plate (not shown). The combustion chamber 15 is air/gas tight except for means to supply combustion air through flame arrestor 30 and to exhaust combustion products through flue 10.

Pilot flame establishment can be achieved by a piezoelectric igniter. A pilot flame observation window (not shown) can be provided which is sealed. Cold water is introduced at a low level of the tank 6 and withdrawn from a high level in any manner as already well known.

Referring now to FIGS. 1–6, the invention also includes an air distribution, metering, and combustion staging apparatus 99 for combustion chamber 15 of water heater 2 equipped with flame arrestor 30. We found that flame arrestor 30 imposes a large flow restriction of the combustion air entering combustion chamber 15 as well as asymmetry in air distribution to burner 74. We also found that this flow imbalance produces nonuniform stoichiometry around the periphery of the typically axisymmetric burner, with resulting performance penalties in $NO_x$ production in the regions where stoichiometry is not optimal. These nonuniformities arise in both the primary combustion zone, where there may be incomplete mixing of the gas and primary combustion air, and the secondary region where combustion is completed by additional air available at the exit of the burner ports.

The reactions by which $NO_x$ is formed are strongly dependent on temperature, with higher flame temperatures producing substantially more $NO_x$ than the amounts created at lower temperatures. Since these high flame temperatures occur in mixtures closest to stoichiometric air/fuel ratios, it is desirable to avoid operating in such a regime. Generally, this is accomplished by ensuring that the overall combustion air is sufficient to increase the stoichiometric ratio well above a value of 1.0, typically to a value of 1.2 or above. Local stoichiometries, however, can vary significantly from the bulk value if air is provided in a nonuniform distribution to the burner and is incompletely mixed prior to combustion at the burner ports. Thus, some regions of the burner can be operating in a manner which produces high levels of $NO_x$ while other regions do not, resulting in an elevated average $NO_x$ concentration in the total flow of combustion products in the flue. Similar mechanisms can produce undesirable levels of CO emissions in nonuniform or poorly mixed gas/air mixtures if localized stoichiometries are such that the oxidation of CO to $CO_2$ cannot be completed before flame temperatures drop below a critical level.

Additional control of $NO_x$ emissions may be achieved through the implementation of staged combustion, in which combustion is initiated under fuel-rich conditions and allowed to proceed for a certain time without the addition of secondary air. During this time, heat is drawn from the flame to minimize $NO_x$ formation when secondary air is eventually added. This heat removal may be accomplished by radiation or conduction away from the flame, and one way to do this is by attaching the flame to a metal surface such as a plate. The secondary air is then added in sufficient quantity to produce fuel-lean bulk conditions, and is mixed in rapidly to minimize the time that any localized region spends near stoichiometric conditions.

Figure 5:
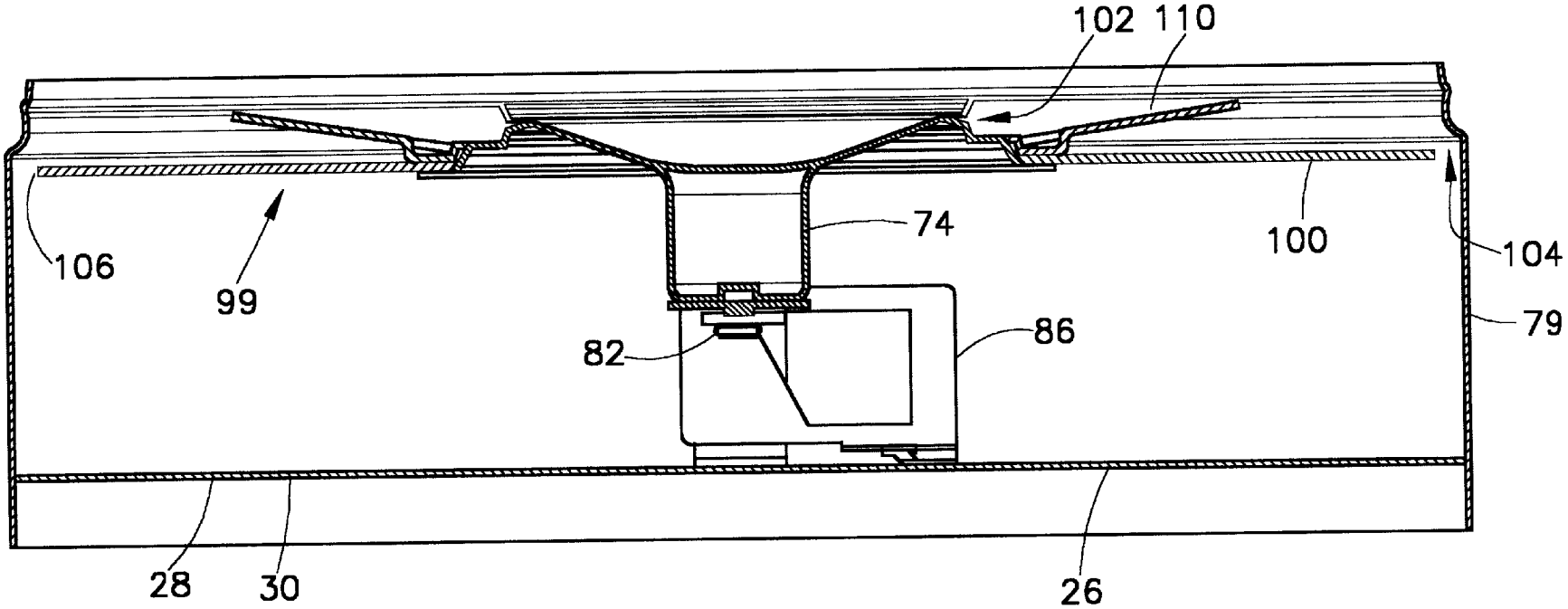
FIG. 5 is a cross-sectional view taken through the line V—V of FIG. 4.
Figure 6:
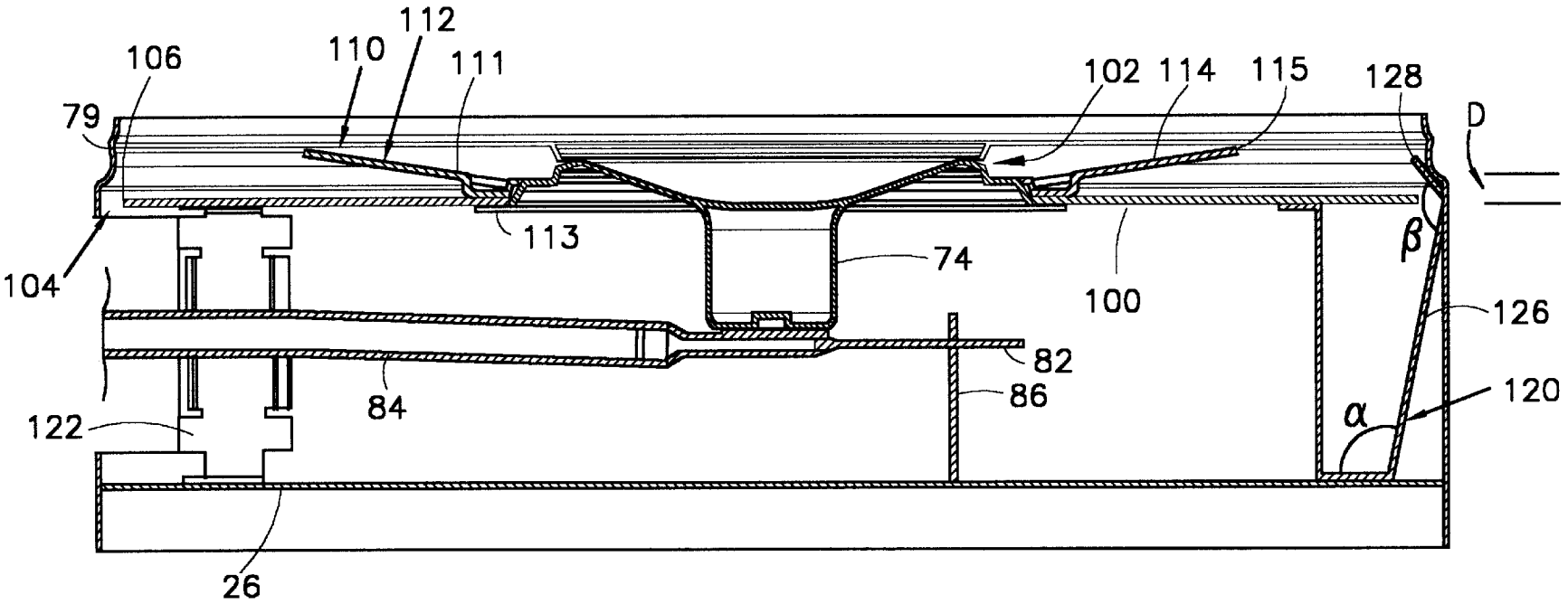
FIG. 6 is a cross-sectional view taken through the line VI—VI of FIG. 4.

Apparatus 99 of the invention improves the performance of the combustion system by providing a means to more evenly distribute the air entering chamber 15 via the flame arrestor 30 and thus produce a more uniform stoichiometry around the burner periphery. Referring particularly to FIGS. 5 and 6, a circular flat plate 100 is installed in chamber 15 substantially concentric with burner 74 with the surface from about 0.05 to 0.5 inches, preferably ¼", lower than the lower edge of burner ports 102 as shown by distance D. Plate 100 is positioned to allow burner 74 to be inserted and removed while plate 100 remains fixed in combustion chamber 15. Burner 74 is formed from two metallic sheets fixed together. The upper sheet thereof has a smaller diameter than the lower sheet. The metallic sheets are shaped to form a multiplicity of elongated and radially extending channels 103 through which premixed gas and air flow prior to combustion and the lower sheet has an opening positioned at a distal end portion of substantially all of the channels 103. Channels 103 terminate at burner ports 102. This mode of combustion is brought about so that $NO_x$ emissions are reduced due to the proportioning and premixing of the air and fuel in proper ratios and so that combustion takes place in a slower and substantially even manner. Moreover, the multiplicity of holes 108 supply further even quantities of air calculated to lower flame temperatures, thereby reducing $NO_x$ emissions still further. This configuration inhibits soot formation or "candling" at nozzle 129.

The diameter of plate 100 is sized to create a gap 104 of about 0.125 to about 0.75 inches between its outer edge 106 and skirt 79 of combustion chamber 15 that is small relative to the overall diameter of combustion chamber 15. The impingement and subsequent redistribution of air on the underside of plate 100 results in a more even flow to and around burner 74. Additionally, the pressure drop of the secondary air around outer edge 106 of plate 100 can be adjusted by the width of gap 104 between plate 100 and skirt 79 and/or gap between the top of the outer edge 115 (see below) and lower surface 108 (see FIG. 1) of water storage tank 6, thus allowing more or less secondary air to be admitted.

Since the overall airflow into the chamber is restricted by flame arrestor 30, control of the secondary air accordingly provides a means to control the amount of primary air entering burner 74 and thus the overall primary fuel/air ratio. Additionally attached to the upper surface of plate 100 by five spot welds 101 is a staging flange 110, comprising a ring 112 with an inner edge 111 having the same inner diameter of plate 100 and an outer edge 115 having diameter that is preferentially smaller than outer edge 106 of plate 100. The top surface 114 of the flange 110 serves as a means for the flame from the burner ports to attach to the flange 110, thereby reducing the flame temperature via heat loss due to radiation from the surface 114. The flange 110 angles upwardly from inner edge 111, preferably at an angle between about 5° and about 10°, more preferably at about 7°, such that the flange 110 only contacts plate 100 at its inner edge 113.

The flange 110 is positioned vertically so that the inner portion of top surface 114 is substantially flush with the bottom surface of the burner ports 102. This position and geometry is important for two reasons. First, the upward slope/angle causes the flames to attach substantially continuously to top surface 114 of flange 110, thereby transferring heat from the flames to flange 110 which reduces peak temperatures and minimizes $NO_x$ production. Second, since outer edge 115 of flange 110 is raised above plate 100, the flames will attach only to flange 110 and not to any exposed surface of plate 100. This allows the function of each component to remain separate and can be easily and independently adjusted. Plate 100 controls the relative amounts of primary and secondary air and provides a means for more even distribution of both flows. Flange 110 controls both the radiative heat loss and the time the combustion gases spend in the primary combustion zone prior to secondary air being introduced by adjustment of its width. These in turn control various combustion processes such as formation of $NO_x$ and the burnout of carbon monoxide.

Apparatus 99 is supported by three brackets 120, 122 and 124. Brackets 122 and 124 are the same and simply act as support legs. Bracket 120 is substantially in a square "U" shape and, not only acts as a support leg, but has a positioning function by virtue of the length of support 126, holder 128 and angles $\alpha$ and $\beta$, which cause plate 100 to be substantially horizontally and vertically fixed into a desired position. This is especially important to maintain gap 104 substantially even between skirt 79 and outer edge 106.

Thus, the invention serves to control the combustion processes by distributing total combustion air more uniformly and metering the relative proportions of the primary and secondary air, as well as by controlling the heat release and staging. Each function can be individually tailored so that the net effect is the optimization of the overall burner system including, but not limited to, improvements in the emissions of $NO_x$ and carbon monoxide, the efficiency of heat transfer to the water storage tank, and the peak metal temperatures of the combustion apparatus.

Installation of apparatus 99 is accomplished as follows:

The air distribution plate 100 with staging flange 110 is installed permanently in combustion chamber 15 prior to attaching tank 6 to skirt 79. Later, burner 74 and the manifold assembly are installed into combustion chamber 15 through opening 80 such that burner 74 is raised up through the center of plate 100 and a seal is formed between edge 106 of plate 100 and the extended lower lip of burner 74. Burner 74 is then supported by the tip 82 of fuel line 84 at support bracket 86 and by the front cover. The joint between burner 74 and plate 100 is recessed to capture condensate and keep scale away from burner ports 102.

It is to be understood that the invention disclosed and defined herein extends to all alternative combinations of the individual features mentioned or evident from the text or drawings. All of these different combinations constitute various alternative aspects of the invention. The foregoing describes embodiments of the present invention and modifications, obvious to those skilled in the art can be made to them, without departing from the scope of the present invention.

What is claimed is:

1. A water heater comprising:

a water container;

a combustion chamber adjacent the container, said combustion chamber having a side wall and at least one flame arrestor to admit air and extraneous fumes into said combustion chamber and confine ignition and combustion of said extraneous fumes within said combustion chamber;

a burner having a multiplicity of burner ports associated with said combustion chamber and arranged to combust fuel to heat water in said container;

an air diverter comprising a plate, said diverter positioned in said combustion chamber and below said burner ports, said plate sized to form a gap between its outer edge and said side wall and adapted to channel combustion air passing through at least a portion of said flame arrestor through said gap; and a flange positioned 1) above said air diverter, at least a portion of said flange being angled upwardly from said air diverter and 2) relative to said burner ports such that flames generated by combustion of said fuel tend to attach to at least a portion of the flange.

2. The water heater defined in claim 1, wherein the plate is substantially flat.

3. The water heater defined in claim 1, wherein said plate and said flange have central openings and an edge portion of said flange central opening connects to said air diverter.

4. The water heater defined in claim 1, wherein said flange is angled at an angle of about 5° to about 10°.

5. The water heater defined in claim 1, wherein the air diverter is positioned from about 0.05 inches to 0.5 inches below said burner ports.

6. The water heater defined in claim 1, wherein said gap is from about 0.125 inches to about 0.75 inches.

7. The water heater defined in claim 1, wherein said burner comprises two metallic sheets fixed together and wherein an upper sheet thereof has a smaller diameter than a lower sheet thereof.

8. The water heater defined in claim 7, wherein said metallic sheets are shaped to form a multiplicity of elongated and radially extending channels through which premixed gas and air flow prior to combustion.

9. The water heater defined in claim 8, wherein the lower sheet has an opening positioned at a distal end portion of substantially all of said channels.

10. The water heater defined in claim 3, wherein the flange central opening is sized about the same as the plate central opening.

11. The water heater defined in claim 1, wherein the flange central opening and the plate central opening are substantially aligned.

12. The water heater defined in claim 3, wherein the plate and the flange are fixed together substantially at their respective central openings.

13. The water heater defined in claim 1, wherein the burner is removable from the combustion chamber without moving the diverter.

14. The water heater defined in claim 1, further comprising a set of legs upon which the plate is supported.

15. The water heater defined in claim 14, wherein at least one of the legs maintains the plate in a selected position.

16. The water heater defined in claim 1, wherein the side wall has an opening sized to permit removal of the burner from the combustion chamber.

17. The water heater defined in claim 1, wherein attachment of the flames to the flange lowers flame temperature and thereby reduces $NO_x$ emissions.

18. The water heater defined in claim 3, wherein the plate central opening is larger than the diameter of said burner.

19. The water heater defined in claim 1, wherein the plate and the gap are positioned to cause combustion air passing to the burner to be substantially uniform in flow rate around the burner outer edge.

20. The water heater defined in claim 1, wherein the air diverter plate and the gap are positioned to meter relative amounts of primary and secondary air.

21. A water heater comprising:

a water container;

a combustion chamber adjacent the container having a side wall;

a burner having a multiplicity of burner ports associated with said combustion chamber and arranged to combust fuel to heat water in said container;

an air diverter comprising a plate, said diverter positioned in said combustion chamber and below said burner ports, said plate sized to form a gap between its outer edge and said side wall and adapted to channel combustion air passing through said gap; and a flange positioned 1) above said air diverter, at least a portion of said flange being angled upwardly from said air diverter and 2) relative to said burner ports such that flames generated by combustion of said fuel tend to attach to at least a portion of the flange.

* * * * *